US006804485B2

(12) United States Patent
Martin et al.

(10) Patent No.: US 6,804,485 B2
(45) Date of Patent: Oct. 12, 2004

(54) PHOTOCONDUCTIVE MEMBER FOR ASYNCHRONOUS TIMING OF A PRINTING MACHINE

(75) Inventors: Michael J. Martin, Hamlin, NY (US); Joseph M. Wing, Ontario, NY (US); Mark A. Omelchenko, Lexington, KY (US)

(73) Assignee: Xerox Corporation, Stamford, CT (US)

( * ) Notice: Subject to any disclaimer, the term of this patent is extended or adjusted under 35 U.S.C. 154(b) by 26 days.

(21) Appl. No.: 10/278,129

(22) Filed: Oct. 22, 2002

(65) Prior Publication Data

US 2004/0076450 A1 Apr. 22, 2004

(51) Int. Cl.[7] ..... G03G 15/00
(52) U.S. Cl. ..... 399/159; 399/160
(58) Field of Search ..... 399/130, 159, 399/160, 162

(56) References Cited

U.S. PATENT DOCUMENTS

| | | | | |
|---|---|---|---|---|
| 5,946,533 A | | 8/1999 | Omelchenko et al. | 399/223 |
| 5,966,572 A | * | 10/1999 | Mishra et al. | 399/160 |
| 6,219,516 B1 | * | 4/2001 | Furst et al. | 399/301 |

* cited by examiner

*Primary Examiner*—Hoan Tran

(57) ABSTRACT

A photoconductive member for use in a single pass multi-color printing machine is disclosed. The photoconductive member is composed of an inter seam zone having a physical seam. The inter seam zone includes one of a plurality of image-on-image registration marks respective to a particular color latent image formed on the photoconductive member in a single pass. A plurality of interdocument zones is also included on the photoconductive member wherein process control marks are formed. While the inter seam zone is used for monitoring color-to-color registration, the process control marks are monitored to adjust the timing of the printing machine so that copy media synchronizes with an asynchronous placement of the images on the photoconductive member. A single pass, multi-color electrophotographic printing machine architecture uses a vertically oriented photoconductive belt. Transfer of the toner powder images occur at the lowermost portion of the photoconductive belt. The photoconductive belt is elliptically shaped, having a major and a minor axis. N image recording stations are positioned adjacent an exterior surface of the photoconductive belt on one side of the major axis thereof. N−1 image recording stations are positioned adjacent the exterior surface of the photoconductive belt on the other side of the major axis thereof. The image recording stations record electrostatic latent images on the photoconductive belt. This architecture optimizes image registration while minimizing the overall height of the printing machine.

30 Claims, 3 Drawing Sheets

PHOTOCONDUCTIVE MEMBER FOR ASYNCHRONOUS TIMING OF A PRINTING MACHINE

Figure 1:
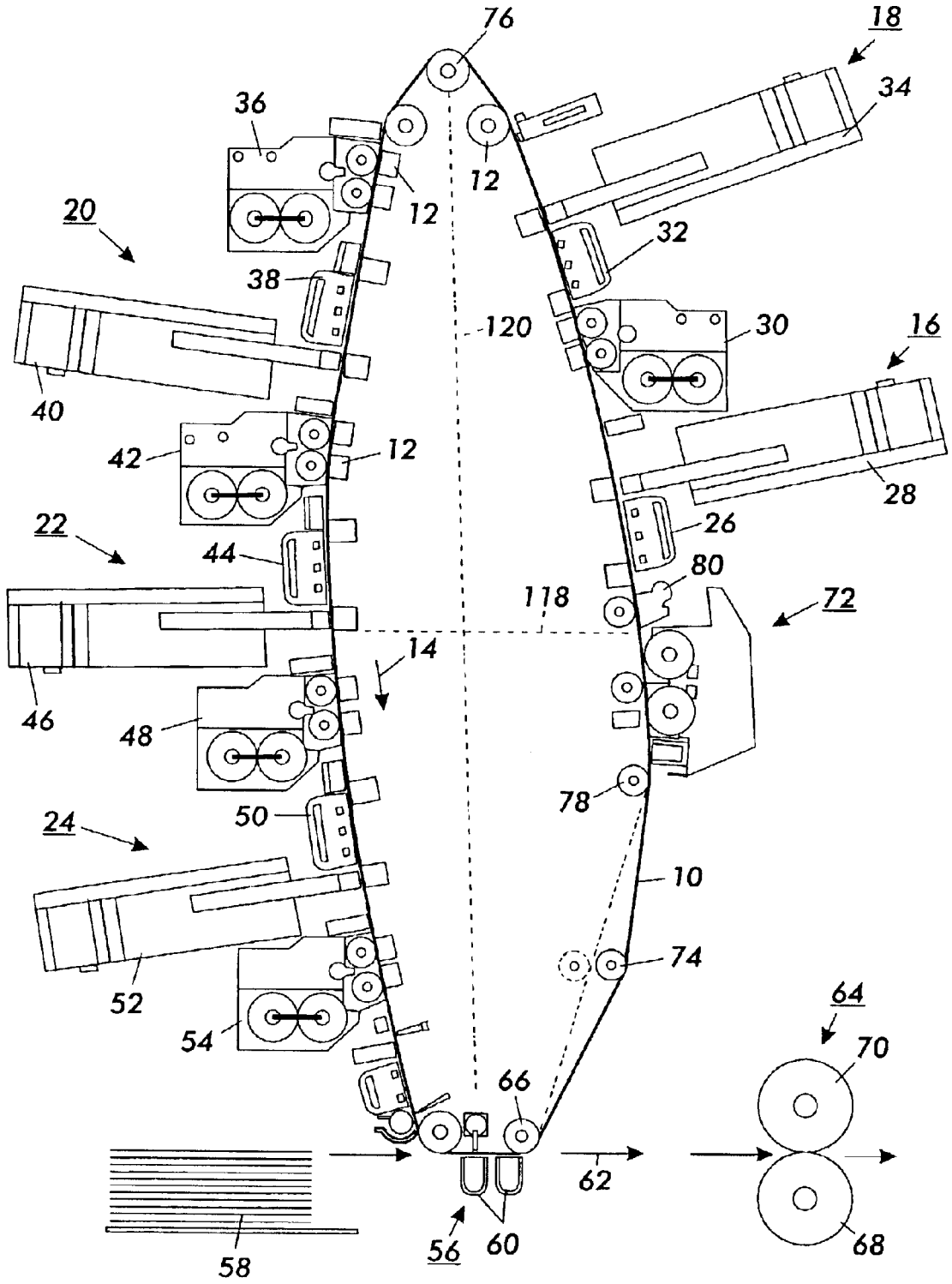

This invention relates to a photoconductive member for use in a single pass multi-color printing machine, and more particularly, concerns a photoconductive belt having a larger interdocument zone in the photoconductive belt seam area and a smaller sized interdocument zone for all other belt areas. This results in a printing machine that has an asynchronous timing pattern. System software needs to detect the asynchronous interdocument zones and adjust paper copy media handling timing, primarily sheet feed timing, in order to maintain image to copy media synchronization. By implementing an asynchronous timing approach, photoconductive belt length can be optimized and maximum usage of belt length can be used for printing copies thus providing desired print rate and productivity with smaller photoconductive belt length and reduced machine/motor velocities.

In a typical electrophotographic printing machine a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas to record an electrostatic latent image on the photoconductive member corresponding to the informational areas contained within the original document. After the electrostatic latent image is recorded on the photoconductive member, bringing a developer material into contact therewith develops the latent image. Generally, the electrostatic latent image is developed with dry developer material comprising carrier granules having toner particles adhering triboelectrically thereto. However, a liquid developer material may be used as well. The toner particles are attracted to the latent image, forming a visible powder image on the photoconductive surface. After the electrostatic latent image is developed with the toner particles, the toner powder image is transferred to copy media. Thereafter, the toner image is heated to permanently fuse it to the copy media.

It is highly desirable to use a photoconductive member of this type in an electrophotographic printing machine to produce color prints. In order to produce a color print, the printing machine includes a plurality of stations. Each station has a charging device for charging the photoconductive surface, an exposing device for selectively illuminating the charged portions of the photoconductive surface to record an electrostatic latent image thereon, and a developer unit for developing the electrostatic latent image with toner particles. Each developer unit deposits different color toner particles on the respective electrostatic latent image. The images are developed, at least partially in superimposed registration with one another, to form a multi-color toner powder image. The resultant multi-color powder image is subsequently transferred to a sheet. The transferred multi-color image is then permanently fused to the sheet forming the color print.

Electrophotographic printing machines to date use a photoconductive member that is a seamed belt coated with a photoconductive material. Images are laid down on the belt such that an interdocument zone follows the image area, and since the seamed area of the belt results in an image quality defect, the seam area of the belt is kept within an interdocument area. Thus, the interdocument zones are limited to receiving latent process control patches that enable the electrophotographic process to be monitored and controlled.

In the past the photoconductive belt length was determined by a combination of various parameters. These parameters consist of time constants required between each of the steps in the electrophotographic process such as the physical size of the electrophotographic components, size of the patches required for electrophotographic process controls, and image panel sizes. Thus, in a given electrophotographic printing machine having a given architecture, with N image panels there are N interdocument zones including the one placed over the seam. In previous machines for a given pitch mode, the interdocument zones were all of equal size, and the system timing was constant and synchronous.

A multicolor printing machine of this type having architectures using a single sized interdocument zone requires an overly long photoconductive belt and a large frame structure to support it. A large machine height results when the major axis of the photoconductive member is aligned vertically and serious concerns over machine operability, service, shipping, and machine handling arise. Likewise, a photoconductive belt having an overly long length has very low yields when made in large quantities. In order to reduce of the machine height and photoconductive belt length an asynchronous timing approach was developed wherein firstly, an inter seam zone, on the photoconductive belt, includes the physical belt seam as well as image-on-image registration patches. Secondly, while using the inter seam zone for monitoring image-on-image registration, interdocument zones include patches that govern process control. Finally, the machine timing of the system is adjusted so that copy media is synchronized with the asynchronous placement of the images on the photoconductive belt. This requires system software to adjust system timing to synchronize media with images.

Various types of multi-color printing machines have heretofore been employed. The following disclosure appears to be relevant:

U.S. Pat. No. 5,946,533

Patentee: Omelchenko et al.

Issued: Aug. 31, 1991

U.S. Pat. No. 5,946,533 discloses a single pass, multi-color electrophotographic printing machine architecture which uses a vertically oriented photoconductive belt. Transfer of toner powder images occur at the lowermost portion of the photoconductive belt. The photoconductive belt is elliptically shaped, having a major and minor axis. N image recording stations are positioned adjacent an exterior surface of the photoconductive belt on one side of the major axis thereof. N−1 image recording stations are positioned adjacent the exterior surface of the photoconductive belt on the other side of the major axis thereof. The image recording stations record electrostatic latent images on the photoconductive belt. This architecture optimizes image registration while minimizing the overall height of the printing machine.

In accordance with the features of the present invention, there is provided a photoconductive member for use in a single pass multi-color printing machine. The photoconductive member is composed of an inter seam zone having a physical seam. The inter seam zone includes one of a plurality of image-on-image registration marks respective to a particular color latent image formed on the photoconductive member in a single pass. A plurality of interdocument zones is also included on the photoconductive member wherein process control marks are formed. While the inter seam zone is used for monitoring image-to-image registration, the process control marks are monitored to adjust the timing of the printing machine so that copy media synchronizes with an asynchronous placement of the images on the photoconductive member.

Figure 2:
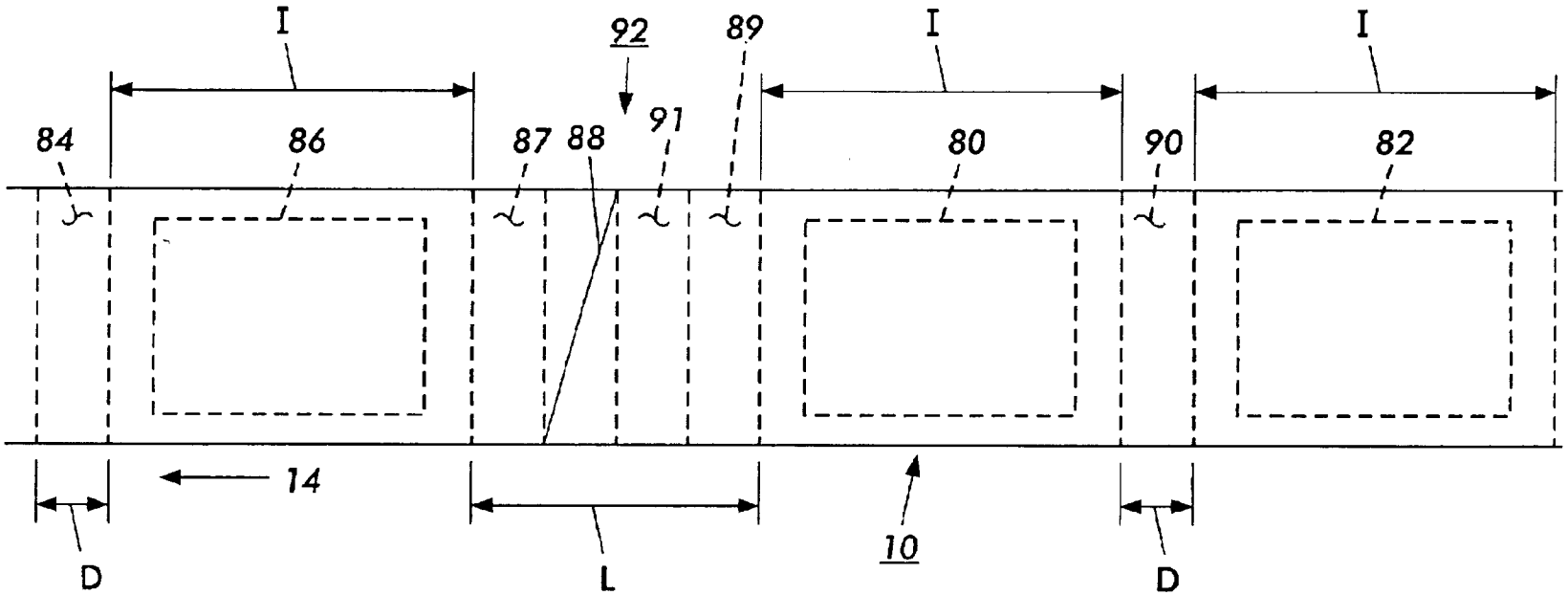

Other aspects of the present invention will become apparent as the following description proceeds and upon reference to the drawings, in which:

FIG. 1 is a schematic, elevational view showing a single pass multi-color printing machine architecture; and FIG. 2 is a schematic view of a partial layout for a 10 pitch photoconductive member, which incorporates the principles of the present invention.

Figure 3:
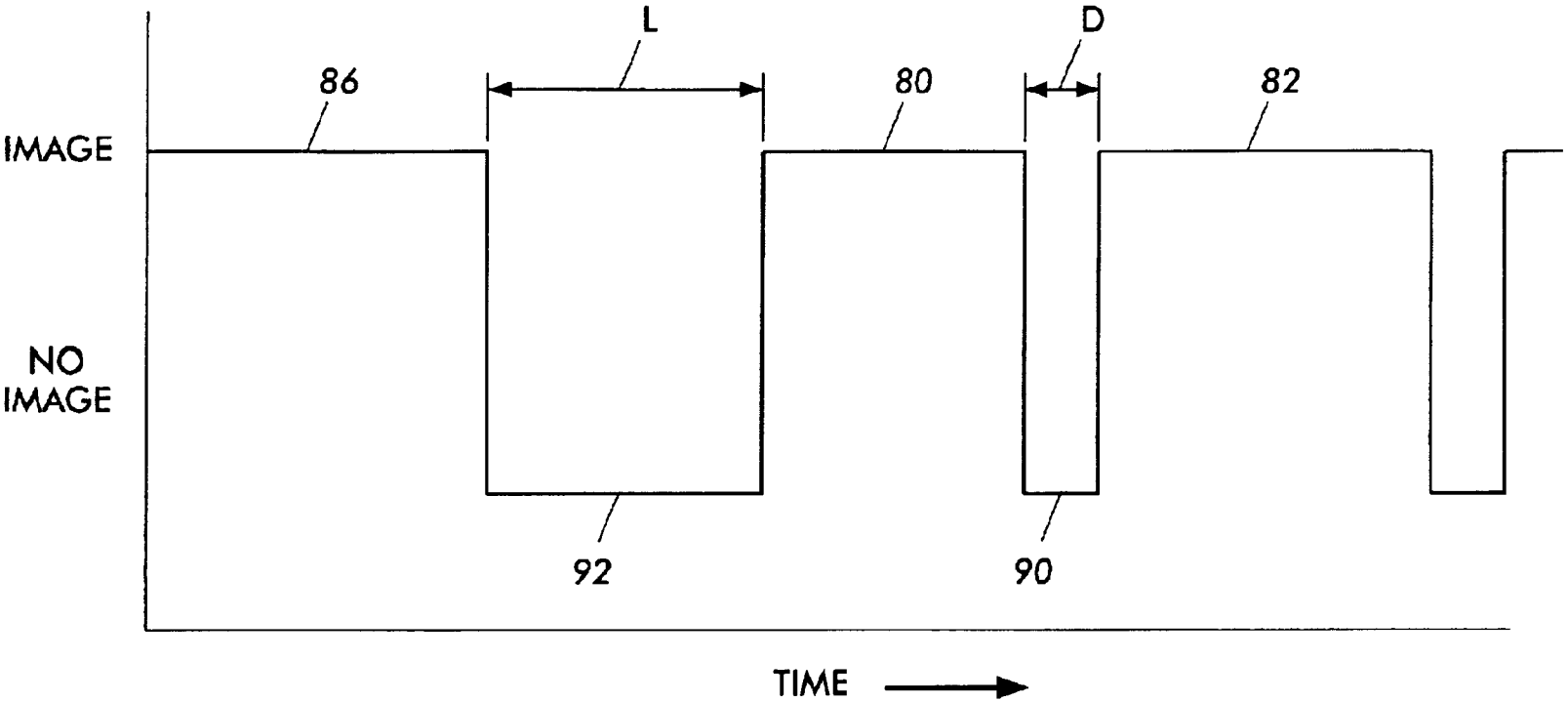

FIG. 3 presents a partial timing diagram for the layout of the photoconductive member shown in FIG. 2.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements.

Referring now to FIG. 1, there is shown a single pass multi-color printing machine. This printing machine employs a photoconductive member 10, which will described in further detail with reference to FIG. 2. The photoconductive belt 10 is supported by a plurality of rollers or bars 12 and is arranged in a vertical orientation. As shown in FIG. 1, photoconductive belt 10 advances in the direction of arrow 14 to move successive portions of its external surface sequentially beneath the various processing stations disposed about the path of movement thereof.

FIG. 2 illustrates a partial schematic view of a 10 pitch photoconductive member incorporating the principles of the present invention to reduce the length of belt 10 and also, reduce the height of the printing machine in which it is housed. As the photoconductive member 10 travels in the direction of arrow 14 each part of it passes through the subsequently described process stations shown in FIG. 1. For convenience, sections of the photoconductive member 10 are identified. An Image area is the part of the photoconductive member 10 that is to be exposed and developed as subsequently explained, to produce a composite image. Likewise, an interdocument zone is limited to receiving latent process control patches that enable the electrophotographic process to be monitored and controlled.

Turning now to FIG. 2, it is to be understood that photoconductive member 10 may include more than one Image area. For example, FIG. 2 shows photoconductive member 10 having a first Image area 80, a second Image area 82, a tenth Image area 86 all of a constant length I. Images are laid down on belt 10 such that an interdocument zone follows the image area. For example the Image area 80 is followed by an interdocument zone 90 and the ninth Image area (not shown) is followed by an interdocument zone 84. Even if the photoconductive belt 10 has only four image areas, for example, instead of ten it still has interdocument areas separating the lead and trail edges of the images. There will be an equal number of interdocument zones as image areas.

Since the seamed area of photoconductive belt 10 results in an image quality defect, the seam area of the belt is also kept within an interdocument zone. Interdocument zone 92 not only includes belt seam 88 but, contains a No Write zone 87 at the lead edge of seam 88, a No Write zone 91 at the trail edge of seam 88, and an Image-On-Image registration zone 89. As shown in FIG. 2, interdocument zone is a length L that is considerably longer than the constant length D of the other interdocument zones laid out on the photoconductive member 10.

FIG. 3 presents a partial timing diagram for the layout of the photoconductive belt 10 to further show the Image Write zones 86, 80, and 82 along with the interdocument zones 90 and 92 illustrated in FIG. 2. According to the principles of the present invention image-on-image registration occurs in zone 89 (see FIG. 2) after the trail edge of the No Write zone 91 in the interdocument zone 92 (see FIG. 2). Likewise, the process control marks (not shown) are laid down in zone interdocument zone 90. In this manner, the inter seam zone 92 is used for monitoring image-on-image registration and the process control marks in zone 90 are monitored to adjust the timing of the printing machine so that copy media synchronizes with an asynchronous placement of the images on the photoconductive member 10.

Referring again to FIG. 1, the printing machine architecture includes five image recording stations indicated generally by the reference numerals 16, 18, 20, 22, and 24, respectively. Initially, photoconductive member 10 passes through image recording station 16. Image recording station 16 includes a charging device and an exposure device. The charging device includes a corona generator 26 that charges the exterior surface of photoconductive member 10 to a relatively high, substantially uniform potential. After the exterior surface of photoconductive member 10 is charged, the charged portion thereof advances to the exposure device. The exposure device includes a raster output scanner (ROS) 28, which illuminates the charged portion of the exterior surface of photoconductive member 10 to record a first electrostatic latent image thereon. Alternatively, a light emitting diode (LED) may be used.

This first electrostatic latent image is developed by developer unit 30. Developer unit 30 deposits toner particles of a selected color on the first electrostatic latent image. After the highlight toner image has been developed on the exterior surface of photoconductive conductive member 10.

Photoconductive member 10 continues to advance in the direction of arrow 14 to image recording station 18.

Image recording station 18 includes a recharging device and an exposure device. The charging device includes a corona generator 32, which recharges the exterior surface of photoconductive belt 10 to a relatively high, substantially uniform potential. The exposure device includes a ROS 34, which illuminates the charged portion of the exterior surface of photoconductive member 10 selectively to record a second electrostatic latent image thereon. This second electrostatic latent image corresponds to the regions to be developed with magenta toner particles. This second electrostatic latent image is now advanced to the next successive developer unit 36.

Developer unit 36 deposits magenta toner particles on the electrostatic latent image. In this way, a magenta toner powder image is formed on the exterior surface of photoconductive member 10. After the magenta toner powder image has been developed on the exterior surface of photoconductive member 10, photoconductive member 10 continues to advance in the direction of arrow 14 to image recording station 20.

Image recording station 20 includes a charging device and an exposure device. The charging device includes corona generator 38, which recharges the photoconductive surface to a relatively high, substantially uniform potential. The exposure device includes ROS 40 which illuminates the charged portion of the exterior surface of photoconductive member 10 to selectively dissipate the charge thereon to record a third electrostatic latent image corresponding to the regions to be developed with yellow toner particles. This third electrostatic latent image is now advanced to the next successive developer unit 42.

Developer unit 42 deposits yellow toner particles on the exterior surface of photoconductive member 10 to form a yellow toner powder image thereon. After the third electrostatic latent image has been developed with yellow toner, photoconductive member 10 advances in the direction of arrow 14 to the next image recording station 22.

Image recording station 22 includes a charging device and an exposure device. The charging device includes a corona generator 44, which charges the exterior surface of photoconductive belt 10 to a relatively high, substantially uniform potential. The exposure device includes ROS 46, which illuminates the charged portion of the exterior surface of photoconductive member 10 to selectively dissipate the charge on the exterior surface of photoconductive member 10 to record a fourth electrostatic latent image for development with cyan toner particles. After the fourth electrostatic latent image is recorded on the exterior surface of photoconductive member 10, photoconductive member 10 advances this electrostatic latent image to the cyan developer unit 48.

Cyan developer unit 48 deposits cyan toner particles on the fourth electrostatic latent image. These toner particles may be partially in superimposed registration with the previously formed yellow powder image. After the cyan toner powder image is formed on the exterior surface of photoconductive member 10, photoconductive member 10 advances to the next image recording station 24.

Image recording station 24 includes a charging device and an exposure device. The charging device includes corona generator 50, which charges the exterior surface of photoconductive belt 10 to a relatively high, substantially uniform potential. The exposure device includes ROS 54, which illuminates the charged portion of the exterior surface of photoconductive member 10 to selectively discharge those portions of the charged exterior surface of photoconductive member 10, which are to be developed with black toner particles. The fifth electrostatic latent image, to be developed with black toner particles, is advanced to black developer unit 54.

At black developer unit 54, black toner particles are deposited on the exterior surface of photoconductive member 10. These black toner particles form a black toner powder image, which may be partially or totally in superimposed registration with the previously formed highlight color, yellow, magenta, and cyan toner powder images. In this way, a multi-color toner powder image is formed on the exterior surface of photoconductive member 10. Thereafter, photoconductive belt 10 advances the multi-color toner powder image to a transfer station, indicated generally by the reference numeral 56.

At transfer station 56, a receiving medium, i.e., paper, is advanced from stack 58 by sheet feeders and guided to transfer station 56. At transfer station 56, a corona generating device 60 sprays ions onto the backside of the paper. This attracts the developed multi-color toner image from the exterior surface of photoconductive member 10 to the sheet of paper. Stripping assist roller 66 contacts the interior surface of photoconductive member 10 and provides a sufficiently sharp bend thereat so that the beam strength of the advancing paper strips from photoconductive member 10. A vacuum transport moves the sheet of paper in the direction of arrow 62 to fusing station 64.

Fusing station 64 includes a heated fuser roller 70 and a back-up roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished sheet is discharged to a finishing station where the sheets are compiled and formed into sets, which may be bound to one another. These sets are then advanced to a catch tray for subsequent removal therefrom by the printing machine operator.

One skilled in the art will appreciate that while the multi-color developed image has been disclosed as being transferred to paper, it may be transferred to an intermediate member, such as a belt or drum, and then subsequently transferred and fused to the paper. Furthermore, while toner powder images and toner particles have been disclosed herein, one skilled in the art will appreciate that a liquid developer material employing toner particles in a liquid carrier may also be used.

Invariably, after the multi-color toner powder image has been transferred to the sheet of paper, residual toner particles remain adhering to the exterior surface of photoconductive belt 10. The photoconductive member 10 moves over isolation roller 78, which isolates the cleaning operation at cleaning station 72. At cleaning station 72, the residual toner particles are removed from photoconductive member 10. The photoconductive member 10 then moves under spots blade 80 to also remove toner particles therefrom.

It has been determined that belt tensioning member 74, preferably a roll, which is resiliently urged into contact with the interior surface of photoconductive member 10, has a large impact on image registration. Heretofore, a roll located in the position of steering roll 76 achieved tensioning of the photoconductive member. In printing machines of this type, the image recording stations were positioned on one side of the major axis, with at most there being one image recording device on the other side thereof. Thus, there would be an image recording device on one side of the major axis of the photoconductive belt, separated by the tensioning roll, followed by four image recording devices positioned on the other side of the major axis of photoconductive member 10. It has been determined that when the height of the photoconductive belt is reduced, requiring two image recording stations to be positioned on one side of the major axis and three image recording stations to be positioned on the other side of the major axis, image-to-image registration is deteriorated. This has been overcome by changing the location of the tensioning roll so as to position it between stripping roller 66 and isolation roll 78 adjacent cleaning station 72. This configuration enabled image-on-image registration to be maintained at the same levels as a printing machine of the previous type, provided that the tensioning mechanism was interposed between stripper roller 66 and isolation roll 78. Tensioning roll 74 is mounted slidably on brackets. A spring resiliently urges tensioning roll 74 into contact with the interior surface of photoconductive belt 10 to maintain belt 10 at the appropriate tension.

In recapitulation, it is clear that the present invention is directed to a printing machine architecture having N image recording stations positioned adjacent an exterior surface of the photoconductive belt on one side of the major axis thereof and N−1 image recording stations positioned adjacent an exterior surface of the photoconductive belt on the other side of the major axis. These imaging stations record electrostatic latent images on the photoconductive belt.

It is, therefore, apparent that there has been provided in accordance with the present invention, a printing machine architecture which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A photoconductive member for use in a single pass multi-color printing machine, comprising:

a plurality of image zones, said image zones receiving images to be recorded on the photoconductive member, an inter seam zone having a physical seam therein said inter seam zone including one of a plurality of image-on-image registration marks relating to a particular color image formed on one of said image zones in the single pass, and a plurality of interdocument zones for forming process control marks thereon while using the inter seam zone for image-on-image registration monitoring to adjust the timing of said printing machine such that copy media synchronizes with an asynchronous placement of the images on the image zones of the photoconductive member.

2. The photoconductive member of claim 1 wherein said inter seam zone further comprises a seam lead edge no write zone.

3. The photoconductive member of claim 1 wherein said inter seam zone further includes a seam trailing edge no write zone.

4. The photoconductive member of claim 1 wherein all of said images zones are of a same length.

5. The photoconductive member of claim 1 wherein all of said interdocument zones are of a same length.

6. The photoconductive member of claim 1 wherein the inter seam zone is longer than any of the interdocument zones.

7. The photoconductive member of claim 1 wherein said photoconductive member moves in a recirculating path.

8. The photoconductive member according to claim 7 wherein said photoconductive member moves past N image recording stations positioned adjacent an exterior surface of said photoconductive member on one side of the major axis thereof, whereby N is greater than one.

9. The photoconductive member according to claim 8 wherein said photoconductive member moves past N−1 image recording stations positioned adjacent an exterior surface of said photoconductive member on the other side of the major axis to record electrostatic images thereon.

10. The photoconductive member according to claim 9 wherein said photoconductive member moves past a plurality of developer units, with one of said plurality of developer units positioned adjacent said image recording stations, to develop the electrostatic images recorded on said photoconductive member with different color toner to form a developed image on the exterior surface of said photoconductive member.

11. The photoconductive member according to claim 10 wherein said photoconductive member moves past a transfer station positioned adjacent said photoconductive member, to transfer the developed image from said photoconductive member to said copy media.

12. The photoconductive member according to claim 11 wherein said photoconductive member moves past a cleaning station, positioned adjacent said photoconductive member, to remove material therefrom after said transfer station transfers the developed image to the receiving medium.

13. In a multi-color printing machine having a moving imaging member, a method of asynchronous timing comprising the steps of:

providing a plurality of image zones said image zones receiving images to be recorded on the imaging member, providing an inter seam zone having a physical seam therein said inter seam zone including one of a plurality of image-on-image registration marks relative to a color image formed on one of said image zones in the single pass, and providing a plurality of interdocument zones for forming process control marks thereon while using the inter seam zone for image-on-image registration monitoring to adjust the timing of said printing machine such that copy media synchronizes with an asynchronous placement of the images on the image zones of the imaging member.

14. The method according to claim 13 wherein said inter seam zone further includes a seam lead edge no write zone.

15. The method according to claim 13 wherein said inter seam zone further includes a seam trailing edge no write zone.

16. The method according to claim 13 wherein all of said images zones are of a same length.

17. The method according to claim 13 wherein all of said interdocument zones of a same length.

18. The method according to claim 13 wherein the inter seam zone is longer than any of the interdocument zones.

19. The method according to claim 13 wherein said imaging member moves in a recirculating path.

20. The method according to claim 19 wherein said imaging member moves past N image recording stations positioned adjacent an exterior surface of said imaging member on one side of the major axis thereof, whereby N is greater than one.

21. The method according to claim 20 wherein said imaging member moves past N−1 image recording stations positioned adjacent an exterior surface of said imaging member on the other side of said major axis to record electrostatic images thereon.

22. The method according to claim 21 wherein said imaging member moves past a plurality of developer units, with one of said plurality of developer units positioned adjacent said image recording stations, to develop the electrostatic images recorded on said imaging member with different color toner to form a developed image on the exterior surface of said imaging member.

23. The method according to claim 22 wherein said imaging member moves past a transfer station positioned adjacent said imaging member, to transfer the developed image from said imaging member to said copy media.

24. The method according to claim 23 wherein said imaging member moves past a cleaning station, positioned adjacent said imaging member, to remove material therefrom after said transfer station transfers the developed image to the receiving medium.

25. An imaging member for use in a multi-color printing machine, comprising:

a plurality of image zones, said image zones receiving images to be recorded on the imaging member, an inter seam zone having an imaging member seam, said inter seam zone having a length L, and including image-on-image registration marks relating to a particular color image formed on one of said image zones, and a plurality of interdocument zones including process control marks to adjust the time of said printing machine for accommodating an asynchronous placement of the images on the imaging member, the length of the interdocument zones being less than the length L of the inter seam zone.

26. The imaging member of claim 25 wherein all of said image zones are of a same length.

27. The imaging member of claim 25 wherein all of said interdocument zones are of a same length.

28. An imaging member for use in a multi-color printing machine, comprising:

a plurality of image zones, said image zones receiving images to be recorded on the imaging member, an inter seam zone having an imaging member seam, said inter seam zone having a given width and including image-on-image registration marks relating to a particular color image formed on one of said image zones, a plurality of interdocument zones including process control marks, the width of the interdocument zones being less than said given width of the inter seam zone, thereon and a control responsive to the registration marks and process control marks to adjust the timing of the printing machine in accordance with an asynchronous placement of images on the imaging member.

29. The imaging member of claim 28 wherein all of said images zones are of a same width.

30. The imaging member of claim 28 wherein all of said interdocument zones are of a same width.

* * * * *